US008420985B2

(12) United States Patent
Dallaire

(10) Patent No.: US 8,420,985 B2
(45) Date of Patent: Apr. 16, 2013

(54) MIRROR AND WINDOW DE-FOGGING DEVICE

(75) Inventor: Richard Dallaire, Whitby (CA)

(73) Assignee: Madeleine Dallaire, Whitby, Ontario (CA)

( * ) Notice: Subject to any disclaimer, the term of this patent is extended or adjusted under 35 U.S.C. 154(b) by 149 days.

(21) Appl. No.: 12/929,702

(22) Filed: Feb. 9, 2011

(65) Prior Publication Data

US 2011/0192831 A1 Aug. 11, 2011

(51) Int. Cl.
*H05B 1/02* (2006.01)

(52) U.S. Cl.
USPC ..... 219/493; 219/203; 219/497; 219/552

(58) Field of Classification Search ..... 219/202–203, 219/494, 492, 497, 505
See application file for complete search history.

(56) References Cited

U.S. PATENT DOCUMENTS 1,517,833 A 12/1924 Gertler et al.
1,852,599 A 4/1932 Zaiger et al.
1,916,355 A 7/1933 Bennett
1,942,359 A 1/1934 Horton et al.
1,960,696 A 5/1934 Cawley
2,103,384 A 12/1937 Somohano
2,171,662 A 9/1939 Marchand
2,585,273 A 2/1952 Prutzman
2,588,825 A 3/1952 Goodman
2,693,589 A 11/1954 Hopkins
2,722,160 A 11/1955 Prutzman
2,796,506 A 6/1957 Lumbert
2,815,433 A 12/1957 Zumwalt
2,843,366 A 7/1958 Hine
2,866,943 A 1/1959 Steele
3,659,582 A 5/1972 Morgan
4,701,594 A 10/1987 Powell
4,966,129 A 10/1990 Curtis
5,063,283 A 11/1991 Orazi
5,414,242 A 5/1995 Kwong
6,365,876 B1 4/2002 Park

*Primary Examiner* — Mark Paschall

(57) ABSTRACT

The de-fogging device and has an elongated heating element mounted within a housing. There is an elongated opening in the housing beneath the heating element for admission of air below the device and a second elongated opening in the housing above the heating element through which air heated by the heating element flows by convection. The device is mounted to a mirror or window and is positioned such that the heated air flows upwardly across the mirror or window. There is means for regulating the temperature of the heating element such that the heated air prevents any moisture in the air surrounding the mirror or window from condensing on it.

20 Claims, 8 Drawing Sheets

MIRROR AND WINDOW DE-FOGGING DEVICE

This application claims priority pursuant to 35 U.S.C. 119 of Canadian patent application No. 2,699,730, filed Feb. 9, 2010, the entire contents of which are herein incorporated by reference.

FIELD OF THE INVENTION

This invention relates to de-fogging devices for mirrors and windows and more particularly to a de-fogging device which is portable and is mounted directly to a mirror or window. No retrofitting of the mirror or window or the way in which the mirror is attached to a wall, frame or other surface is necessary before the de-fogging device, once mounted to the mirror or window, is ready for use.

BACKGROUND OF THE INVENTION

De-fogging devices for removing moisture from mirrors are well known. The devices are commonly found in rooms where the humidity and/or temperature are above normal levels such as bathrooms, commercial laundries, steam baths, and saunas. Some de-fogging devices heat the mirrors by heating elements attached to their rear walls and require electrical junction boxes behind the mirrors to function. The junction boxes and wires to the boxes must usually be installed by licensed electricians. The junction boxes restrict the location of the mirrors and once the boxes are installed, they are permanently located and cannot be removed or relocated without significant cost. An added disadvantage of heating mirrors by this means is that the areas of the mirrors which are electrically heated are usually quite small and accordingly only relatively small areas of mirrors are cleared by the de-fogging devices.

Other de-fogging devices have heaters and fans for causing heated air to flow over mirrors but such devices are expensive to manufacture and are usually noisy and vibrate excessively because of their moving parts.

SUMMARY OF THE INVENTION

I have invented a de-logging device which may be quickly and easily attached to an existing mirror or window. No retrofitting is necessary to install it. Heated air flows upwardly onto a mirror by convection and radiating heat and not by means of a fan. As a result, having no moving parts while the device is operating, there is no noise or vibration at that time. Furthermore, the area over which the heated air flows is usually much larger than that heated by a rear-mounted de-fogging device.

Briefly the de-fogging device of my invention includes: a housing having means for mounting preferably at or slightly above the lower edge of to a vertical surface to be heated; an elongated heating element disposed within the housing and extending parallel to the vertical surface but spaced apart therefrom when the housing is mounted to the vertical surface; a plurality of vanes disposed within the housing and, when the housing is mounted to the vertical surface, having central portions which extend parallel to the vertical surface and upper portions inclined toward the surface, the vanes being separated from one another and from the heating element by spaces which open both down-wardly and upwardly of the housing such that, when the housing is secured to the vertical surface; air beneath the housing enters the spaces where it is heated by the heating element, flows upwardly by convection through the spaces, discharges upwardly from the spaces and flows across the vertical surface with resulting heating of the vertical surface.

DESCRIPTION OF THE DRAWINGS

The de-fogging device of the invention is described with reference to the accompanying drawings in which.

Like reference characters refer to like parts throughout the description of the drawings.

DESCRIPTION OF PREFERRED EMBODIMENTS

The following description is of the de-fogging device of the invention used to prevent moisture from condensing on a mirror but it will be understood that the device can also be used to prevent moisture from condensing on a window or indeed on any vertical surface.

Figure 1:
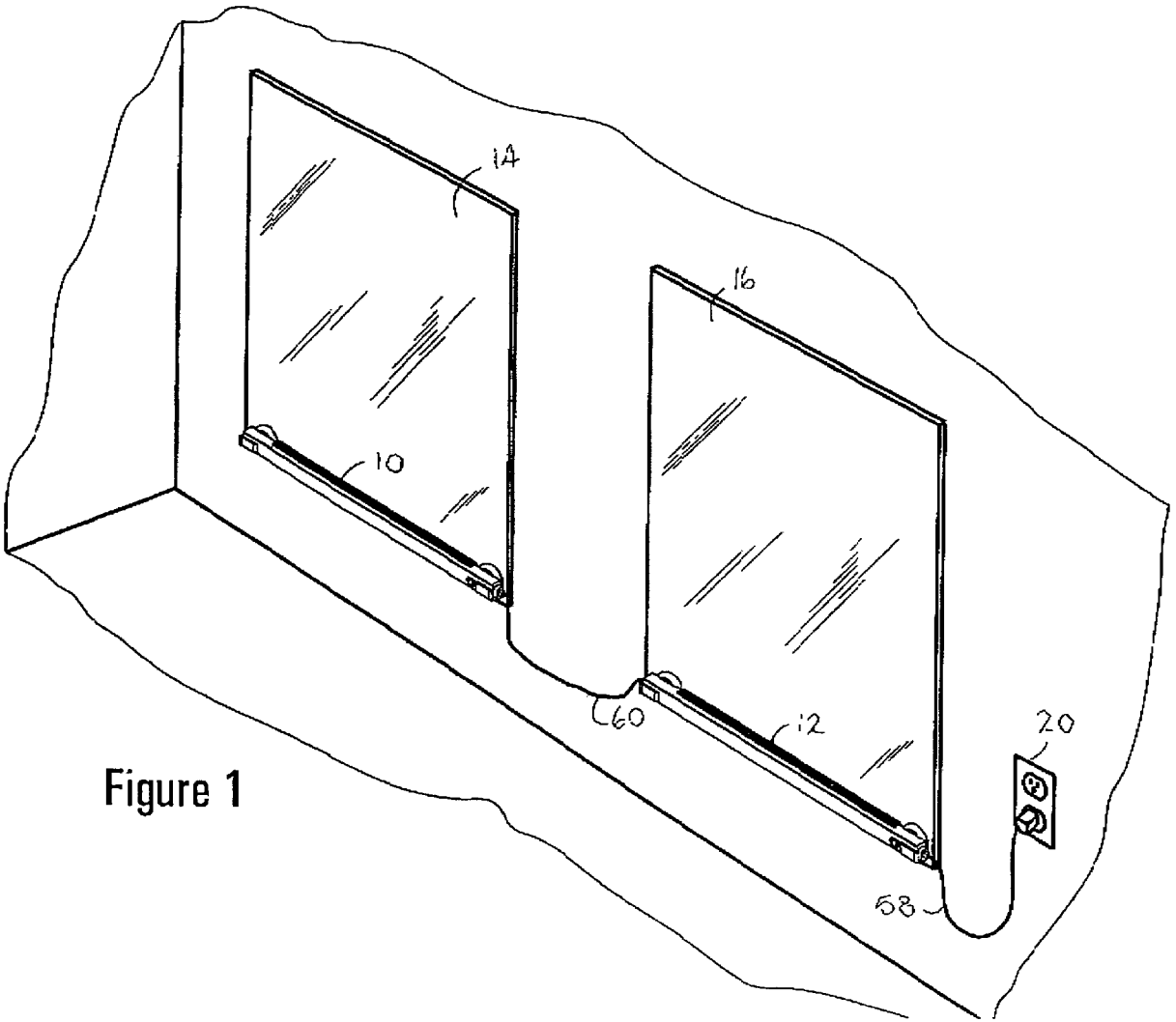
FIG. 1 is a perspective view of two dc-fogging devices mounted side by side at the bottom edge of a pair of mirrors.

With reference to FIG. 1, a pair of de-fogging devices generally 10, 12 are mounted to mirrors 14, 16 typically located in a bathroom. Preferably each device is mounted just above the lower edge of the mirror and typically behind and above one of the sinks. The devices are electrically connected in series to a source of electrical power 20. It is understood that one such device can be used in a bathroom having only one sink and one mirror.

The de-fogging device can be attached to a mirror in any one of a number of different ways. For example, the device can be attached to a mirror such as by a velcro fastener composed of, a double sided adhesive-backed hook and loop or by a double sided adhesive tape. Preferably however the device is attached by suction cups and a description of suction cups suitable for the purpose is described below.

Figure 2:
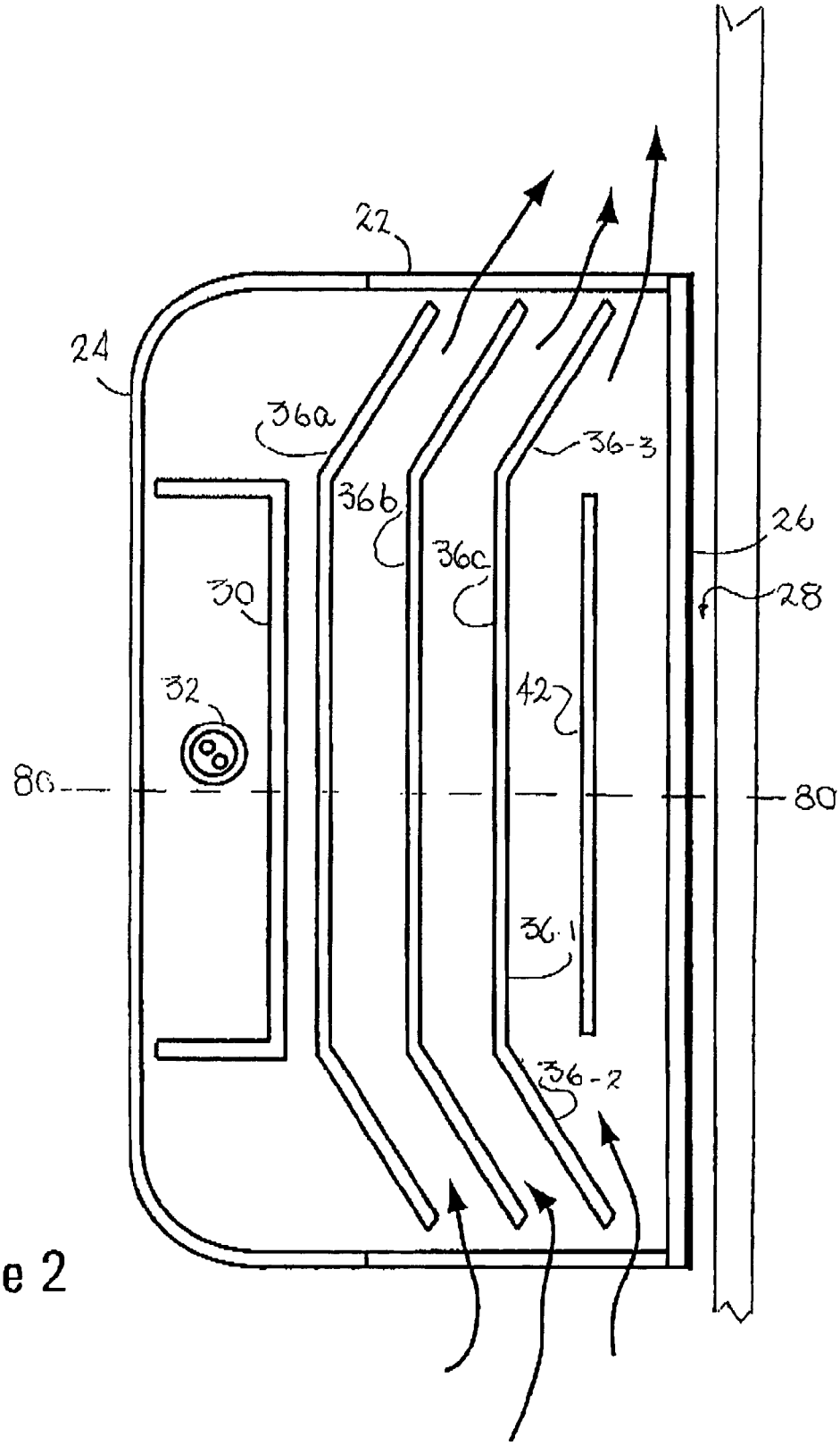
FIG. 2 is a cross-section of the de-fogging device showing the direction of flow through the device.
Figure 3:
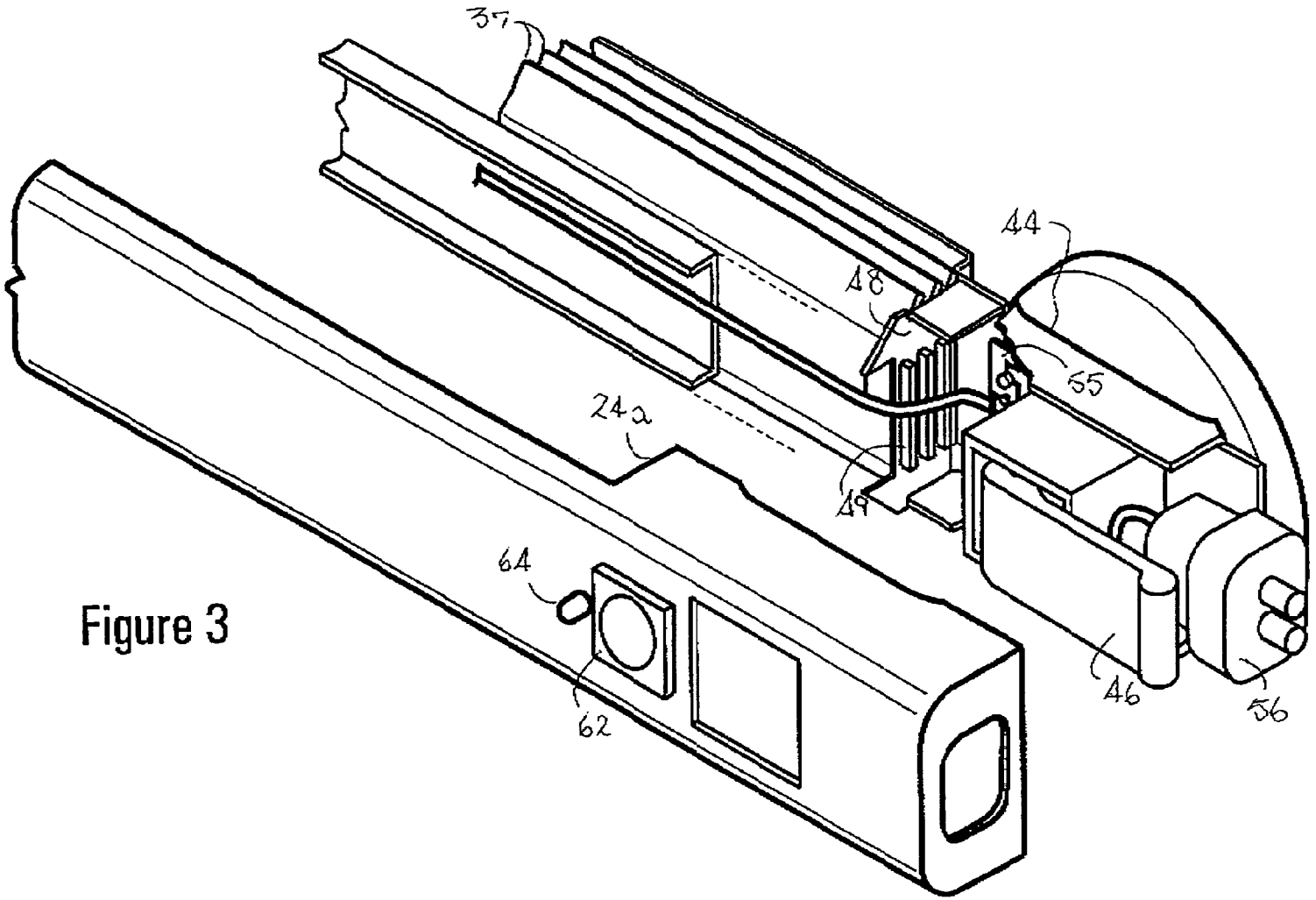
FIG. 3 is an exploded perspective view of the components of the de-fogging device.

With reference to FIGS. 2 and 3, the de-fogging device is accommodated within an elongated housing 22 enclosed at the front and top and bottom by a cover 24. At the back of the housing there is a rear wall 26 which is spaced apart from mirror 14*a* by a gap 28.

Within the interior of the de-fogging device and inward of the removable cover is a heat shield 30 which extends the length of the housing and which, together with the front wall, define a space for accommodation of electrical wires 32. The electrical wires terminate at oppositely facing terminal compartments of the housing and are protected from the heat generated by a heating element by the heat shield. The heating element and terminal compartments are described below.

Further inward of the heat shield are three vanes 36*a,b* and *c*. Like the heat shield, the vanes extend the length of the housing. The vanes are parallel to each other and each is composed of a straight central portion 36-1 and lower and upper terminal portions 36-2 and 36-3. The three portions of the vanes are all straight but are inclined at different angles, the central portion being inclined at a vertical angle while the terminal portions are inclined toward the portion of the mirror above and below the rear wall 26 of the housing. The vanes are positioned close enough to the heating element, described below, such that they are heated by radiant heat from the element.

With reference to FIGS. 2 and 3, the upper edges 37 of the vanes are open to the exterior of the housing through an opening 24*a* in the top of the cover so that air which flows upwardly through the spaces between the vanes may discharge upwardly from the housing. A similar opening (not numbered) is formed in the bottom of the cover so that air beneath the housing may enter the spaces between the vanes and flow upwardly through the spaces. The upper edges of the vanes also function as a conventional grille for preventing unintended or unauthorized access to the hot interior of the housing by for example, children.

Further inward of the heat shield in the interior of the housing is the heating element 42 mentioned previously. The heating element may be any one of a number, of various known such elements. For example it may consist of a wire composed of nichrome or nickel-chromium wound around a strip of mica or nichrome wire coils. It may also be a ceramic heating element.

With reference again to FIG. 3, at the end of the de-fogging device is a terminal compartment, generally 44, to which a handle 46 is pivotally attached for operating a suction cup for attaching and detaching the housing from a mirror. The suction cup and the way in which it operates are described below.

The terminal compartment has a partition wall 48, separates the compartment from the remainder of the housing and functions to protect the contents of the compartments from the heat generated by the heating element. Vertical slots are formed in the partition wall for receipt of tabs 49 formed at the ends of the central portions of the vanes. The tabs function to anchor the vanes in the spaced apart positions illustrated in FIG. 2.

Figure 3A:
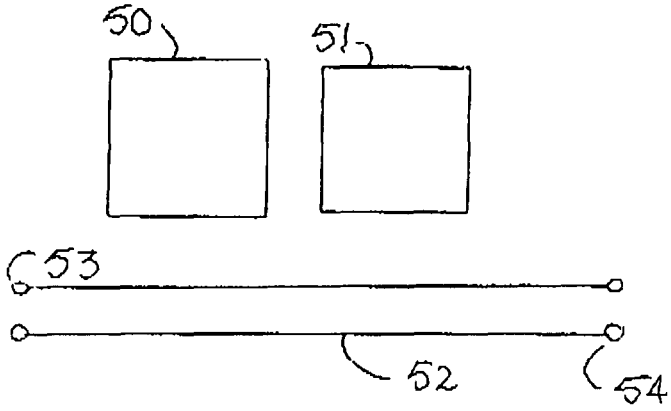
FIG. 3A is a schematic representation of the electrically activated components of the de-fogging device.

With reference to FIG. 3A additional components may be located in the compartment and in circuit with the heating element. The components may be a humidistat 50 and a timer 51 in a circuit 52 with one another and the leads 53 to the heating element and leads 54 to the source of electrical current 20. Instead of, or in addition to the humidistat, the circuit can include a thermostat. The humidistat, thermostat and timer are all conventional.

The humidistat functions to monitor the relative humidity surrounding the housing and when it senses an increase in humidity, it causes the heating element to activate. The timer senses when current begins to flow in the circuit and opens the circuit to deactivate the heating element after a predetermined period of time has elapsed.

If a thermostat is substituted for a humidistat in the circuit, it functions to sense an increase in the temperature of the air surrounding the housing and to cause the heating element to activate. The timer senses when the thermostat has activated the heating element and opens the circuit after a preset period of time has elapsed.

An electrical terminal 55 is provided within the terminal compartment to which wires 32 are attached. The wires are electrically connected to a male plug 56 provided with pins which fit into an electrical socket of an extension cord 58 as illustrated in FIG. 1. The extension cord extends to a plug at the source of electrical current 20.

Figure 4:
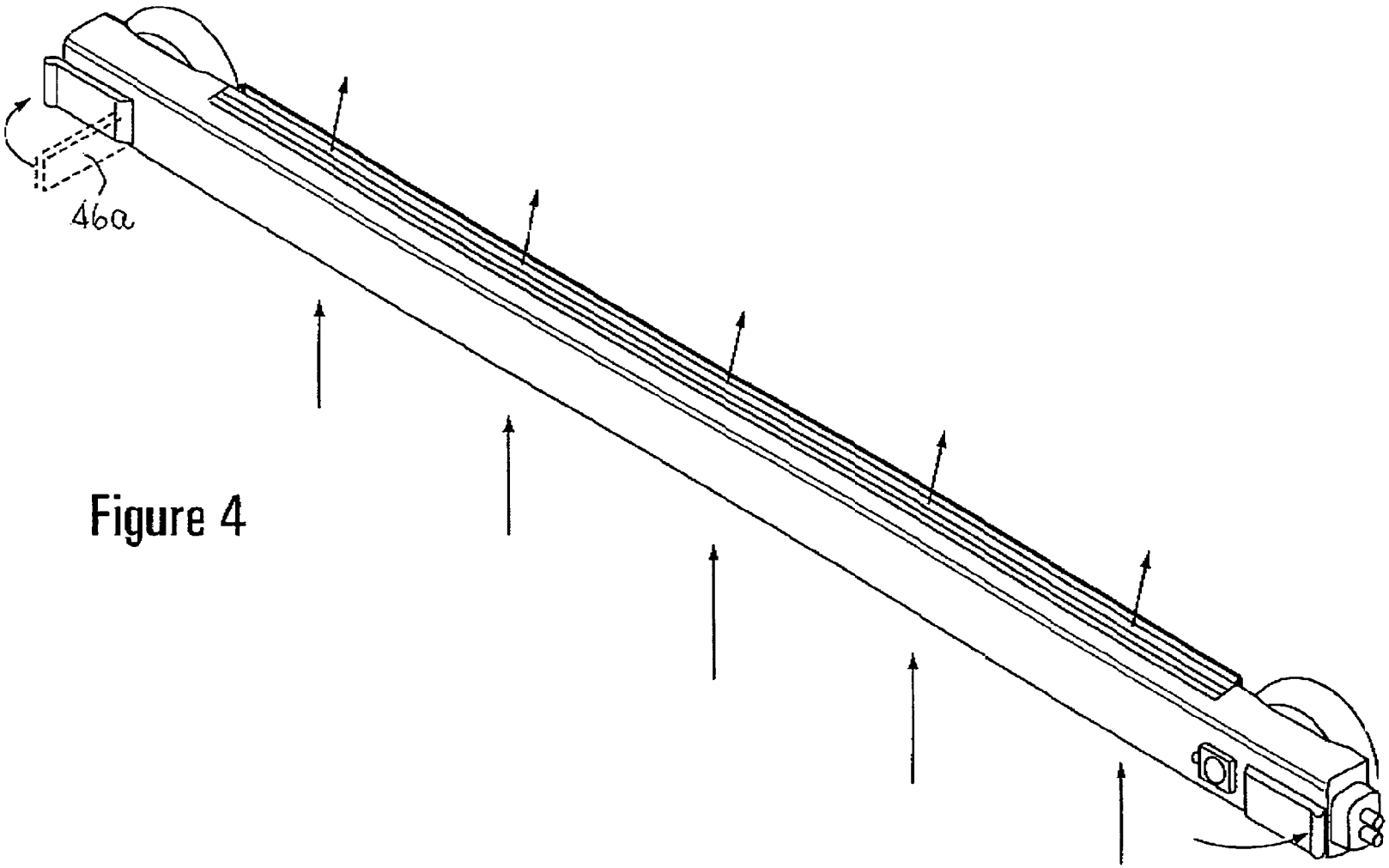
FIG. 4 is a perspective view of the de-fogging device

With reference to FIGS. 1 and 4, there is a terminal compartment at the opposite end of the housing similar to terminal compartment 44 and it too is provided with a handle 46*a* for operating a suction cup at the opposite end of the housing. However, the latter terminal component differs from terminal compartment 44 in that instead of a male plug, there is a female socket. Two de-fogging devices can accordingly be electrically interconnected such as is illustrated in FIG. 1 by means of a second extension cord 60.

With reference to FIG. 3, a push-button switch 62 is provided on the cover of the housing for activating and deactivating the heating element. Adjacent to the switch is a light 64 such as a light emitting diode for indicating when the heating element is activated.

Figure 5:
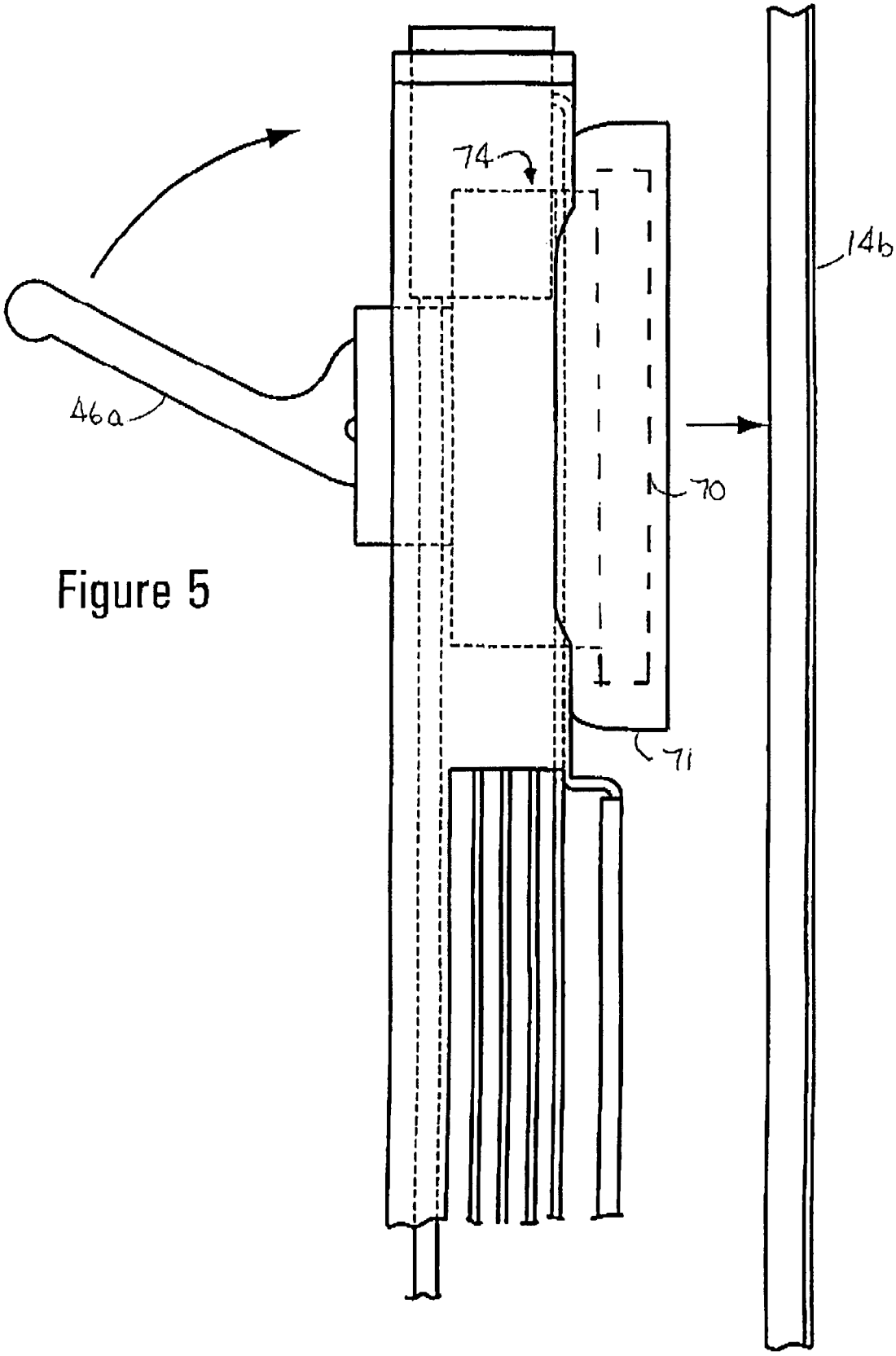
FIG. 5 is an elevation of the de-fogging device when separated from a mirror.
Figure 6:
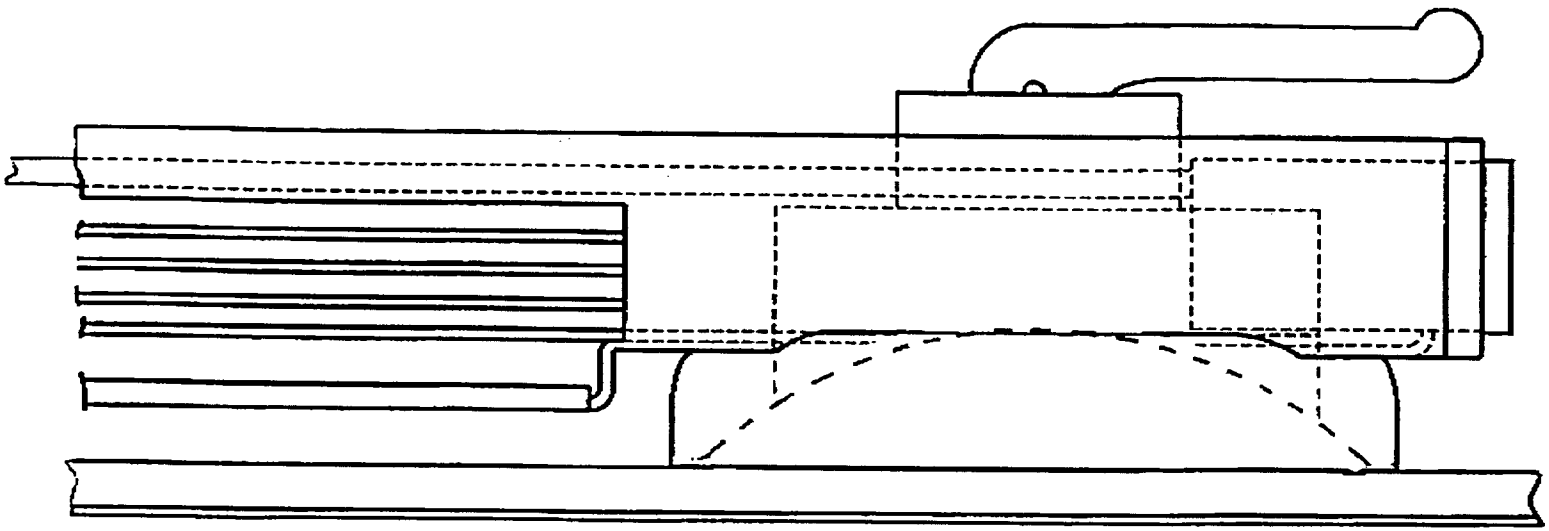
FIG. 6 is an elevation when attached to a mirror.

With reference to FIGS. 5 and 6, the de-fogging device is attached to a mirror by a number of suction cups, one of which is illustrated and is numbered 70. The suction cup is located within an outer cap 71 and is moved into contact and out of contact with mirror 14*b* by means of a handles 46 and 46*a*. The handles are connected to the suction cups by conventional linkages, generally 74.

Figure 7:
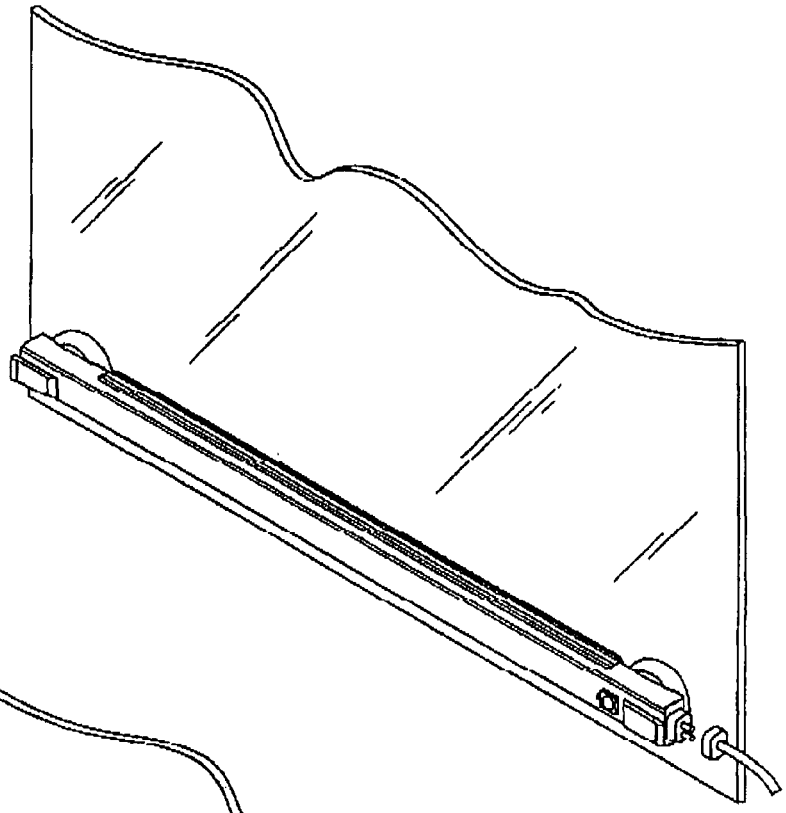
FIG. 7 is an elevation of the de-fogging device shown attached to a mirror.
Figure 8:
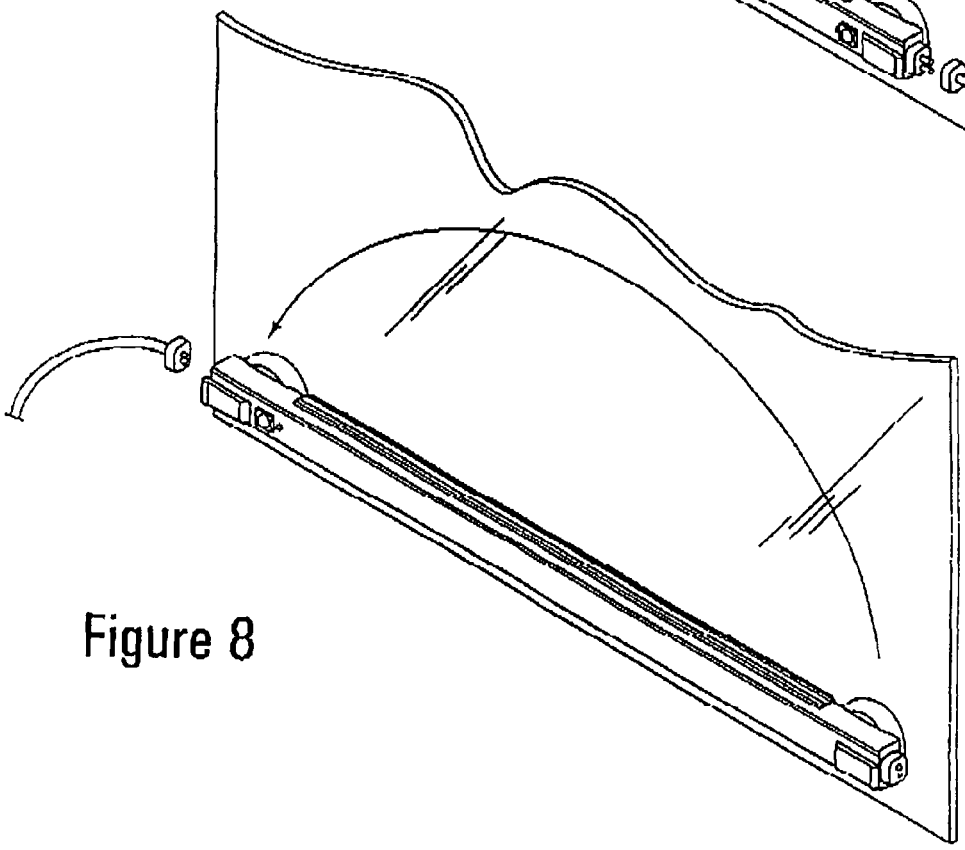
FIG. 8 is an elevation of the same de-fogging device illustrated in FIG. 7 but turned upside down.

With reference again to FIGS. 2 and 4, the vanes and heating element are symmetrical about a plane of symmetry 80-80 so that the dc-fogging device can operate right side up such as is illustrated in FIG. 4 or upside down. When the device is right side up, the male plug is on the right hand end of the device and when upside down it is at the opposite end. The reversible feature of the de-fogging device is also illustrated in FIGS. 7 and 8. In FIG. 7, the male plug is at the right end of the device while in FIG. 8 is at the opposite end. The device is accordingly suitable for use whether the source of power is on the left or right side of a mirror.

It will be obvious that an extension cord used to connect the dc-fogging device to a source of electrical energy can be dispensed with if the device is connected to the electrical source by means of an electrical wire which is permanently connected to the de-fogging device. Such a wire would be connected to the de-fogging device at the end where the male plug is shown in the Figures.

In operation, cool air beneath the de-fogging device flows upward through openings between the lower edges of the vanes, the lower edges of the heating element and between the lower edge of the rear wall of the housing and the minor. As the air enters the openings it is warmed by the heating element and flows upward by convection through the spaces between the vanes the spaces on either side of the heating element and the space between the rear wall of the housing and the mirror. When it reaches the top of the housing the warmed air discharges from the housing and is directed toward the mirror by the upper terminal portions 36-3 of the vanes. When the warmed air contacts the mirror it raises its temperature to above that at which moisture in the air surrounding the mirror will condense on it.

The humidistat and thermostat can be set to monitor rapid changes in relative humidity and temperature respectively. If a rapid change in relative humidity or a rise in temperature occurs such as when a shower is running, the humidistat and thermostat will activate the heating element whereas if the change in humidity or temperature is gradual due to atmospheric changes, the humidistat and thermostat will not respond. Thus daily and seasonal changes in relative humidity or temperature will accordingly not trigger the humidistat and thermostat.

Once the humidistat or thermostat detects a rapid change in humidity or temperature, it triggers a timer which begins a countdown of a preselected interval of time such as 30 minutes, 15 minutes, or 10 minutes. During the countdown, the timer closes the electrical circuit which activates the heating element and at the end of the countdown, the timer opens the circuit thereby deactivating the heating element.

The de-fogging device also has means to turn the device on and off manually. Push-button switch 62 or like switch allows such manual operation. A push button could operate as follows: pushed once, the timer and heating element would be activated and the countdown of the timer would begin. Pushed a second time, the heating element would turn off regardless of where the timer was in its shutdown cycle. Such a feature would allow the de-fogging device to be used to de-fog windows. High humidity levels are generally not found on frosted or fogged household windows so that the de-fogging device would not turn on automatically however manually triggering the device would cause it to turn on. In the case of a mirror in a bathroom, should the mirror be clear after a shower is completed, the bathroom door could be opened to let humid air escape from the bathroom. Pushing the manual on-off button on the de-fogging device would turn the heating element off before the timer finished its cycle. This is a means of conserving electrical energy.

As previously mentioned, the de-fogging device can be right side up as depicted in the drawings or upside down should it be necessary to interchange the position of a male and female plugs from one end of the device to the opposite end.

It will be understood, of course, that modifications can be made in the structure of the de-fogging device and its electrical components without departing from the scope and purview of the invention. For example, the humidistat and thermostat may be located elsewhere than in the terminal compartment of the housing. The humidistat and thermostat may be located at the top of a mirror or window where the temperature and humidity are higher than at the bottom. Being higher, the humidistat and thermostat trigger activation of the heating element sooner with resulting faster, clearing of the mirror or window of moisture. Another possible modification in the structure of the de-fogging device is the addition of a fan within the housing. While a fan is not necessary, if rapid clearing of a minor is required, a fan is useful for doing so.

I claim:

1. A de-fogging device including: a housing having means for mounting to a vertical surface to be heated; an elongated heating element disposed within said housing and extending parallel to said vertical surface but spaced apart therefrom when said housing is mounted to said vertical surface; a plurality of vanes disposed within said housing and, when said housing is mounted to said vertical surface, having central portions which extend parallel to said vertical surface and upper portions inclined toward said surface, said vanes being separated from one another and from said heating element by spaces which open both downwardly and upwardly of said housing such that, when said housing is secured to said vertical surface, air beneath said housing enters said spaces where it is heated by said heating element, flows upwardly by convection through said spaces, discharges upwardly from said spaces and flows across said vertical surface with resulting heating of said vertical surface.

2. The de-fogging device of claim 1 further including means for regulating the temperature of said heating element such that said upwardly discharged air is at or above a temperature at which said discharged air heats said vertical surface to a temperature at which moisture is prevented from condensing on said heated surface.

3. The de-fogging device of claim 1 wherein said upper portions of said vanes are inclined at an angle such that said upwardly discharged air flows across said vertical surface in order to heat said vertical surface.

4. The device of claim 1 wherein said regulating means is a thermostat for activating said heating element when the ambient temperature of air surrounding said device reaches a pre-selected value.

5. The device of claim 1 wherein said regulating means is a humidistat for activating said heating element when ambient humidity surrounding said device reaches a preselected value.

6. The device of claim 1 further having means for positioning said thermostat or said humidistat above and remote from said housing.

7. The device of claim 1 wherein said housing is mounted by means of a velcro fastener; a double sided adhesive tape or one or more suction cups.

8. The device of claim 1 wherein said device is operable whether mounted right side up or upside down.

9. The device of claim 1 including a timer for activating said heating element during a predetermined period of time and for deactivating said heating element at the end of said predetermined period of time; means for periodic determination of the relative humidity and/or temperature of air surrounding said device; means for adjusting the interval of time between each said determination; means for comparing the humidity and/or temperature determined at each said time interval with the humidity and/or temperature at the immediately preceding said time interval; means for activating said tinier when said humidity and/or temperature so compared exceeds a predetermined value with resulting activation of said heating element.

10. The device of claim 9 including means for manually overriding said timer with resulting deactivation of said heating element.

11. A de-fogging device including: a housing having front and back walls and means for mounting to a vertical surface to be heated such that said back wall is parallel to said vertical surface; an elongated heating element disposed within said housing and extending parallel to said vertical surface but spaced apart therefrom when said housing is mounted to said vertical surface; a plurality of vanes disposed within said housing and, when said housing is mounted to said vertical surface, having central portions which extend parallel to said vertical surface and upper portions inclined toward said surface, said vanes being separated from one another and from said heating element by spaces, said back wall also being separated from said heating element and said vertical surface by spaces, said spaces all opening both downwardly and upwardly of said housing such that, when said housing is secured to said vertical surface, air beneath said housing enters said spaces where it is heated by said heating element, flows upwardly by convection through said spaces, discharges upwardly from said spaces and flows across said vertical surface with resulting heating of said vertical surface.

12. The de-fogging device of claim 11 further including means for regulating the temperature of said heating element such that said upwardly discharged air is at or above a temperature at which said discharged air heats said vertical surface to a temperature at which moisture is prevented from condensing on said heated surface.

13. The de-fogging device of claim 11 wherein said upper portions of said vanes are inclined at an angle such that said upwardly discharged air flows across said vertical surface in order to heat said vertical surface.

14. The device of claim 11 wherein said regulating meant; is a thermostat for activating said heating element when the ambient temperature of air surrounding said device reaches a pre-selected value.

15. The device of claim 11 wherein said regulating means is a humidistat for activating said heating element when ambient humidity surrounding said device reaches a preselected value.

16. The device of claim 11 further having means for positioning said thermostat of said humidistat above and remote from said housing.

17. The device of claim 11 wherein said housing is mounted by means of a velcro fastener; a double sided adhesive tape or one or more suction cups.

18. The device of claim 11 wherein said device is operable whether mounted right side up or upside down.

19. The device of claim 11 including a timer for activating said heating element during a predetermined period of time and for deactivating said heating element at the end of said predetermined period of time; means for periodic determination of the relative humidity and/or temperature of air surrounding said device; means for adjusting the interval of time between each said determination; means for comparing the humidity and/or temperature determined at each said time interval with the humidity and/or temperature at the immediately preceding said time interval; means for activating said timer when said humidity and/or temperature so compared exceeds a predetermined value with resulting activation of said heating element.

20. The device of claim 19 including means for manually overriding said timer with resulting deactivation of said heating element.

* * * * *